US007871291B2

(12) United States Patent
Tracy et al.

(10) Patent No.: US 7,871,291 B2
(45) Date of Patent: Jan. 18, 2011

(54) POWER ADAPTER

(75) Inventors: Mark S. Tracy, Tomball, TX (US); Jonathan R. Harris, Cypress, TX (US); Paul J. Doczy, Cypress, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 137 days.

(21) Appl. No.: 11/888,402

(22) Filed: Jul. 31, 2007
(Under 37 CFR 1.47)

(65) Prior Publication Data

US 2009/0035986 A1 Feb. 5, 2009

(51) Int. Cl.
*H01R 13/72* (2006.01)

(52) U.S. Cl. ..... 439/501

(58) Field of Classification Search ..... 439/501, 439/4, 652, 651; 174/35
See application file for complete search history.

(56) References Cited

U.S. PATENT DOCUMENTS 4,528,440 A * 7/1985 Ishihara ..... 392/385
5,418,701 A * 5/1995 Hart ..... 362/376
5,507,667 A 4/1996 Hahn et al.
5,547,393 A * 8/1996 Jansen ..... 439/501
5,690,198 A * 11/1997 Lohr ..... 191/12.2 R
5,700,150 A * 12/1997 Morin ..... 439/4
5,720,628 A 2/1998 Usui et al.
5,923,147 A 7/1999 Martensson
6,153,862 A * 11/2000 Job ..... 219/521
6,305,388 B1 * 10/2001 Zeller ..... 132/314
6,402,546 B1 * 6/2002 Groves et al. ..... 439/501
6,428,348 B1 8/2002 Bean
6,567,277 B1 5/2003 Doherty et al.
6,604,960 B2 8/2003 Liu
6,636,432 B2 10/2003 Chao
6,960,727 B2 11/2005 Hering
7,025,627 B2 4/2006 Rosenthal et al.
7,109,594 B2 9/2006 Liao
7,134,887 B1 * 11/2006 Keely ..... 439/131
7,151,356 B1 12/2006 Chen
7,309,834 B1 * 12/2007 Byrd ..... 174/53
7,554,828 B2 * 6/2009 Wilson ..... 363/146
2003/0038203 A1 * 2/2003 Ohama ..... 242/385
2003/0137810 A1 7/2003 Chen
2004/0097126 A1 * 5/2004 Chen ..... 439/501
2005/0242223 A1 * 11/2005 Woodward ..... 242/376
2006/0196688 A1 * 9/2006 Robertson et al. ..... 174/135
2007/0086613 A1 * 4/2007 Chang et al. ..... 381/333
2007/0097670 A1 * 5/2007 Matthew et al. ..... 362/109

* cited by examiner

*Primary Examiner*—Jean F Duverne

(57) ABSTRACT

A power adapter, comprising a cord Storage assembly extendable from a housing to enable a cord to be at least partially wound thereabout, the cord storage assembly retractable within the housing to store the cord within the housing.

22 Claims, 4 Drawing Sheets

POWER ADAPTER

BACKGROUND

Electronic devices, especially portable electronic devices such as laptop or notebook computers, use power adapters to charge internal and/or travel battery packs and/or provide power to the electronic device. For example, one type of power adapter converts an alternating current (A/C) to a direct current (DC) for use by the electronic device. However, such power adapters are generally difficult to use at least because the power adapter is generally heavy, has numerous cords that must be unpacked and then repacked for storage, and can generate fairly large thermal loads.

DETAILED DESCRIPTION OF THE DRAWINGS

Various embodiments and the advantages thereof are best understood by referring to FIGS. 1-5, like numerals being used for like and corresponding parts of the various drawings.

Figure 1:
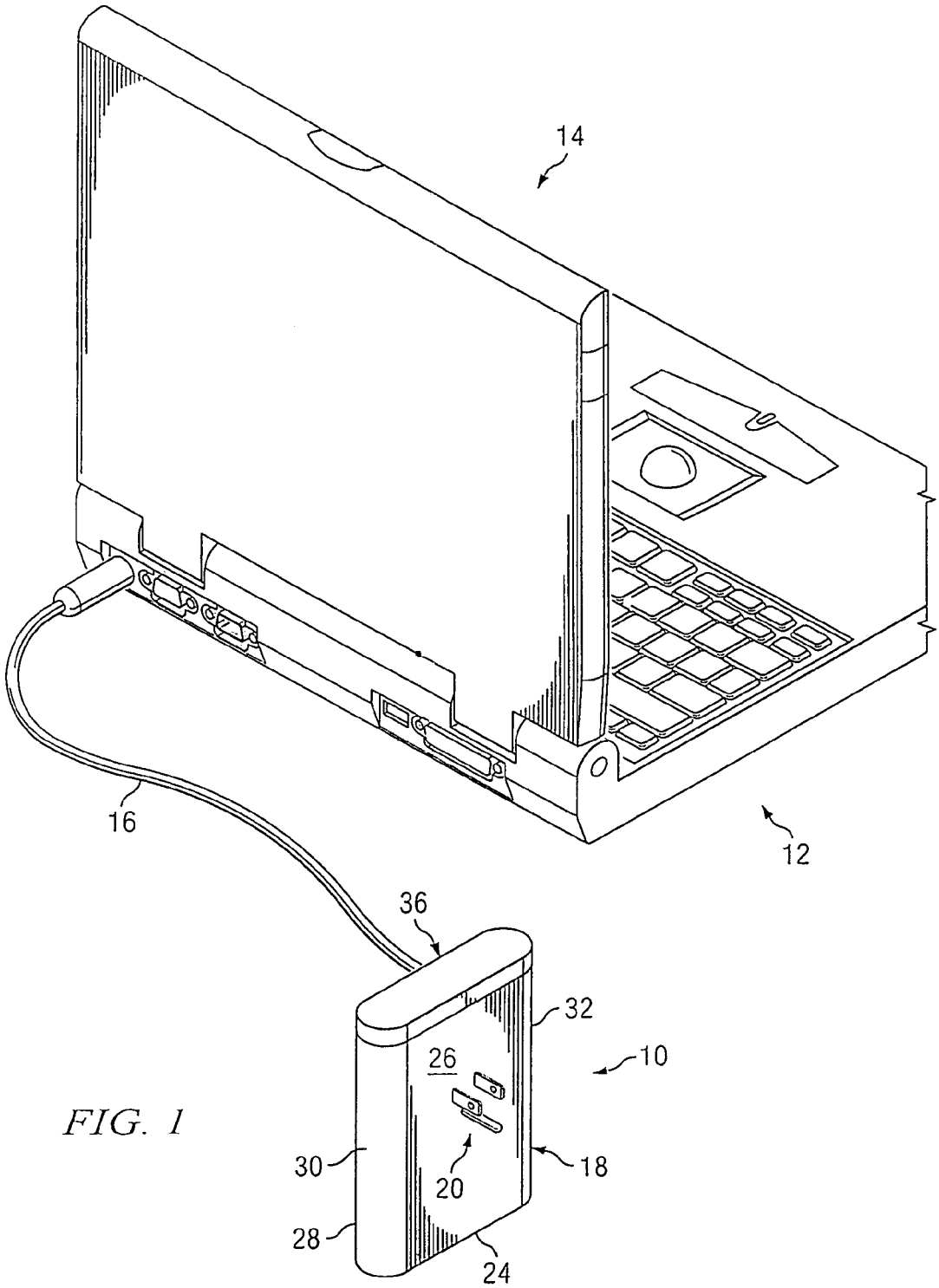
FIG. 1 is a diagram illustrating an embodiment of a power adapter coupled to an electronic device.

FIG. 1 is a diagram illustrating an embodiment of a power adapter 10 coupled to an electronic device 12. In the embodiment illustrated in FIG. 1, electronic device 12 comprises a laptop or notebook computer 14; however, it should be understood that electronic device 12 may comprise any type of electronic device such as, but not limited to, a tablet personal computer, a personal digital assistant, a cellular phone, a desktop computer or any other type of portable or non-portable electronic device.

In the embodiment illustrated in FIG. 1, power adapter 10 is configured to provide power to electronic device 12. In FIG. 1, power adapter 10 comprises a cord 16, a housing 18 and a plug 20 extending from housing 18. Plug 20 is coupleable to an alternating current (A/C) power supply. In FIG. 1, plug 20 is disposed on and/or extends directly from housing 18; however, it should be understood that plug 20 may also be coupled to a cord extending from housing 18 to facilitate connecting of power adapter 10 to an A/C power source. Plug 20 may also comprise a collapsible plug 20.

In the embodiment illustrated in FIG. 1, housing 18 comprises a bottom wall 24, a front wall 26, a rear wall 28 and a pair of sidewalls 30 and 32 configured to store all or a portion of cord 16 therein. For example, in the embodiment illustrated in FIG. 1, power adapter 10 comprises a cord storage assembly 36 extendible and retractable relative to housing 18 for enabling storage of cord 16 within housing 18. For example, in the embodiment illustrated in FIG. 1, cord 16 is at least partially storable within housing 18 to reduce and/or substantially eliminate any excessive, unnecessary and/or unused portions of cord 16 extending between housing 18 and electronic device 12. According to some embodiments, when power adapter 10 is not in use (e.g., during storage, when electronic device 12 is operating on battery power, etc.), all or substantially of all cord 16 is storable within housing 18.

Figure 2:
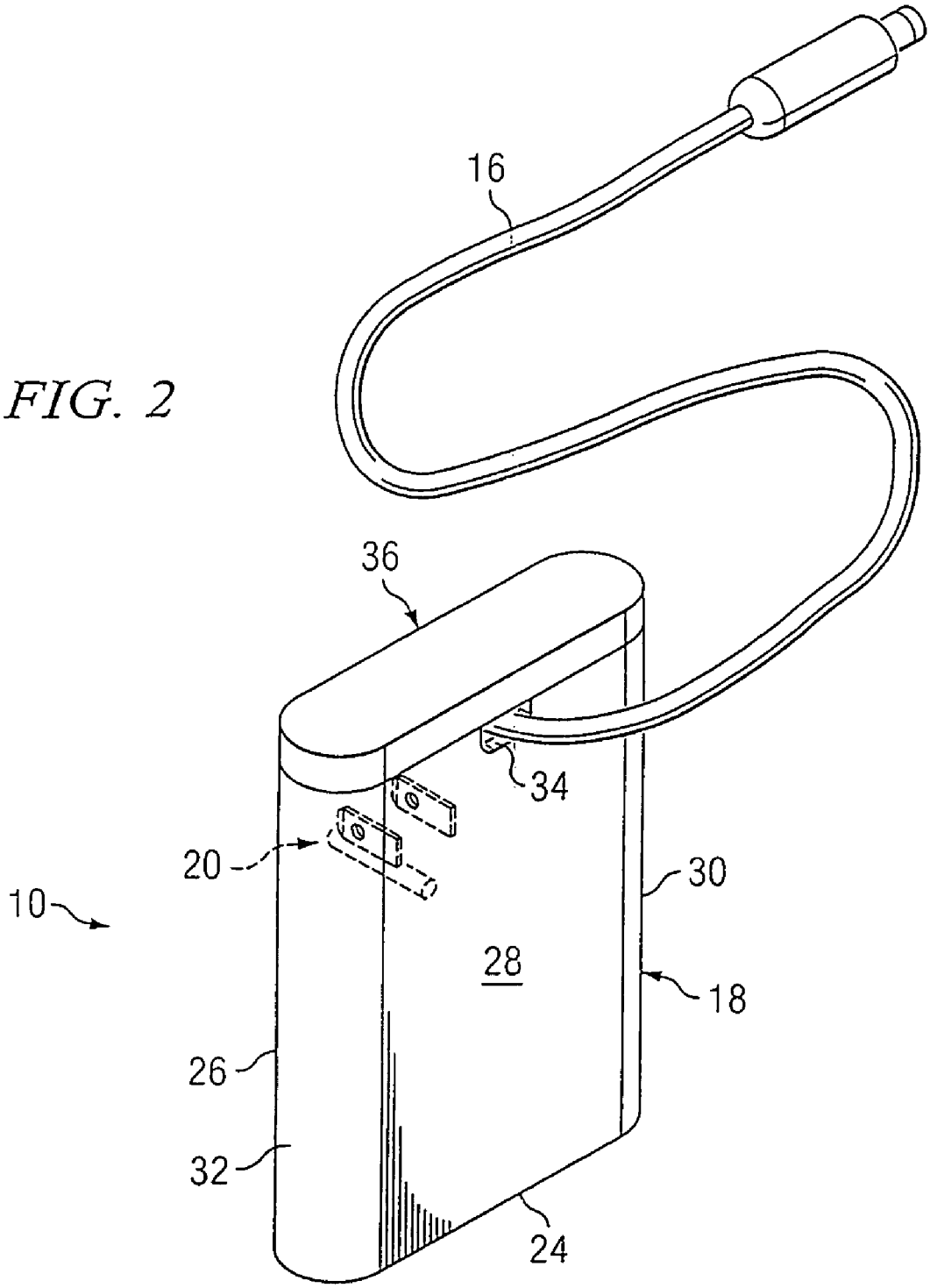
FIGS. 2-5 are diagrams illustrating the power adapter of FIG. 1 in various stages of use.

FIGS. 2-5 are diagrams illustrating power adapter 10 of FIG. 1 in various stages of use. In the embodiment illustrated in FIGS. 2-5, housing 18 comprises a recess 34 to enable cord 16 to pass therethrough (as best illustrated in FIG. 2). Recess 34 is disposed on rear wall 28; however, it should be understood that recess 34 may be otherwise disposed (e.g., disposed at any position on bottom wall 24, front wall 26, sidewalls 30 or 32 or any combination thereof. It should also be understood that cord storage assembly 36 may be formed having a cut-out, recess or other type of opening to enable the passage of cord 16 out of housing 18 when cord storage assembly 36 is in the retracted position.

Figure 3:
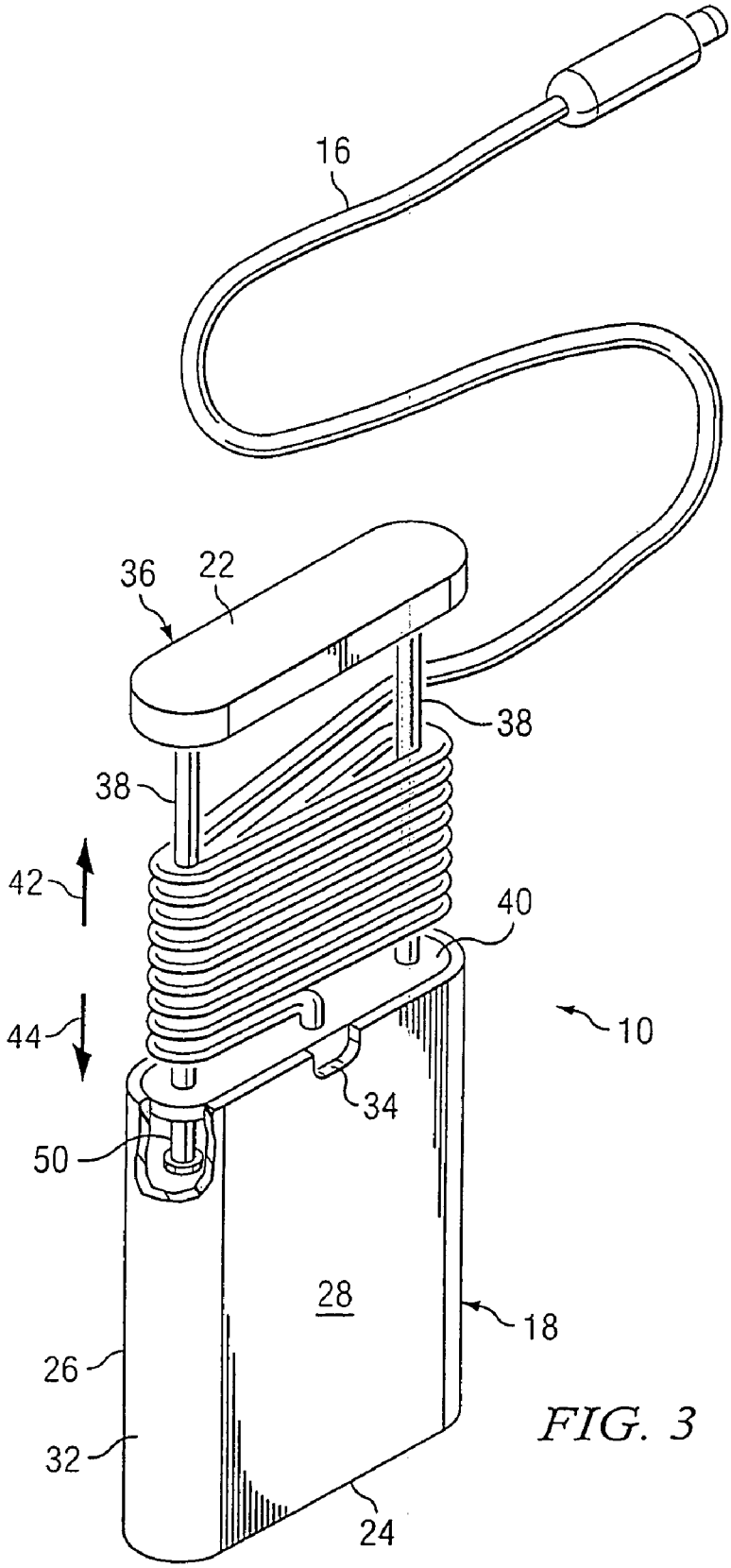
Figure 4:
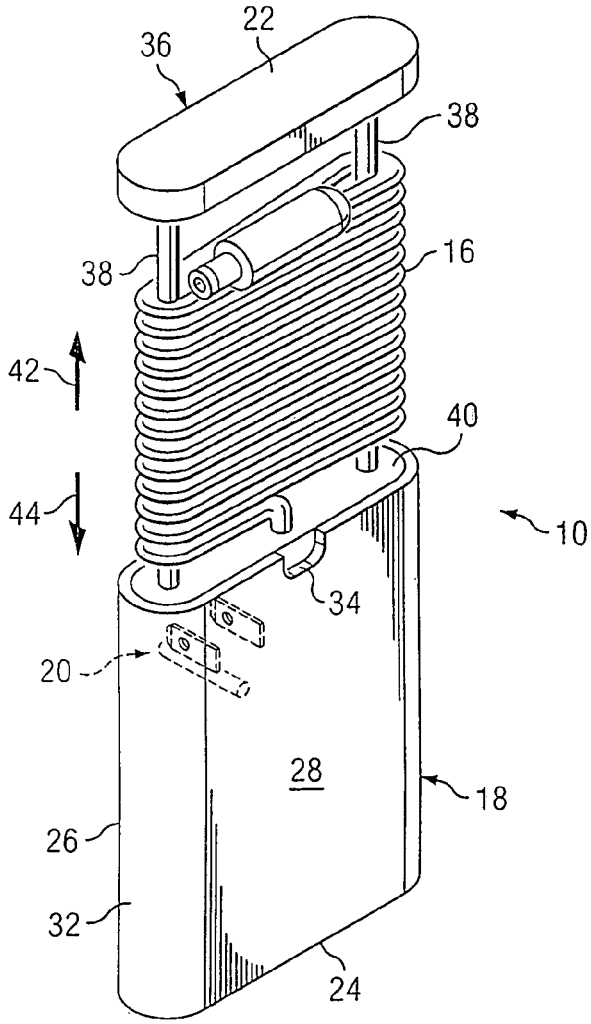

FIGS. 3 and 4 are diagrams illustrating cord storage assembly 36 in an extended position relative to housing 18. As illustrated in FIGS. 3 and 4, cord storage assembly 36 is telescopingly extendable from housing 18 to enable cord 16 to be at least partially wound around storage assembly 36. In FIGS. 3 and 4, cord storage assembly 36 comprises a top wall 22, a converter 40 and a plurality of supports 38 extending between converter 40 and top wall 22 configured such that cord 16 can be fully wound around (FIG. 4) and/or at least partially wound around (FIG. 3) cord storage assembly 36. In the embodiment illustrated in FIGS. 3 and 4, two supports 38 are illustrated; however, it should be understood that storage assembly 36 may be otherwise configured such as, for example, a single support 38 configured such that cord 16 may be wound around the single support 38 (e.g., a single, center-post type of member), a solid panel extending across at least a portion of cord storage assembly 36 around which cord 16 may be wound, etc. In operation, the unused and/or stored portion of cord 16 is wound around supports 38 between top wall 22 and converter 40. In the embodiment illustrated in FIGS. 3 and 4, converter 40 is disposed within housing 18 and is configured to convert alternating current to direct current for use by electronic device 12.

In operation, cord storage assembly 36 is telescopingly extendable and retractable relative to housing 18 in the direction of arrows 42 and 44, respectively. For example, in the embodiment illustrated in FIGS. 3 and 4, when it is desired to place cord storage assembly 36 in a retracted position within housing 18, storage assembly 36 is moved in the direction of arrow 44 relative to housing 18 such that cord 16 and supports 38 are movable into housing 18 for storage therein. In FIGS. 3 and 4, converter 40 is movable within housing 18 in the direction of arrows 42 and 44 in response to extending and/or retracting cord storage assembly 36. According to some embodiments, converter 40 is electrically coupled to plug 20 via a flexible conductive cable or other type of electrical connection. However, it should be understood that circuitry associated with converter 40 may also be configured ot remain stationay in power adapter 10 (e.g., located near a bottom portion of housing 18 and electrically connected to cord 16 and/or cord storage,assembly 36). to enable converter 40 to move within housing 18 in the directions of arrows 42 and 44.

Figure 5:
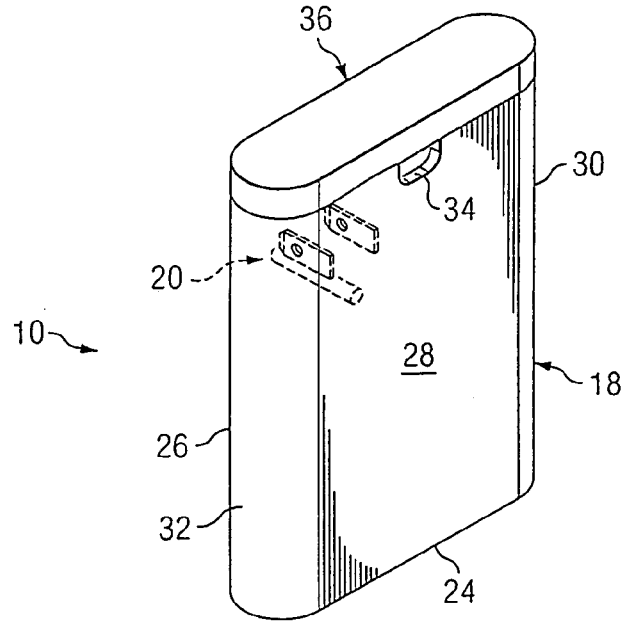

FIG. 5 is a diagram of power adapter 10 of FIG. 1 in a retracted and/or otherwise closed position. In the embodiment illustrated in FIG. 5, cord storage assembly 36 is disposed within housing 18 such that top wall 22 encloses housing 18 and the entirety of cord 16 is stored within housing 18.

In some embodiments, power adapter 10 is manufactured having cord storage assembly 36 telescopingly extendable from housing 18 to enable cord 16 to be at least partially wrapped thereabout. In some embodiments, power adapter 10 is manufactured having storage assembly 36i retractable within housing 18 to store cord 16 within housing 18. In some embodiments, power adapter 10 is manufactured having at least one support 38 extendable from housing 18. In some embodiments, power adapter 10 is manufactured having a recess 34 to enable the cord to pass therethrough when the cord storage assembly 36 is retracted within housing 18. In some embodiments, power adapter 10 is manufactured having converter 40 within housing 18 for converting an alternating current to direct current. In some embodiments, power adapter 10 is manufactured such that housing 18 is configured to receive an entire length of cord 16 for storage within housing 18. In some embodiments, power adapter 10 is manufactured having a plug 20 extending from housing 18 and coupleable to an alterting current source. In some embodiments, power adapter 10 is manufactured having a storage assembly 36 comprising a top wall 22 for enclosing housing 18 when storage assembly 36 is retracted within housing 18.

As illustrated in FIGS. 1-5, in some embodiments, cord storage assembly 36 is slideably coupled to housing 18 to enable telescopic movement therebetween. In some embodiments, housing 18 and/or cord storage assembly 36 may be configured with a stop or other type of element to limit outward movement of cord storage assembly 36 relative to housing 18 to prevent removal of cord storage assembly 36 entirely form housing 18. However, it should be understood that power adapter 10 may be otherwise configured. For example, in some embodiments, power adapter 10 may be configured such that cord storage assembly 36 is entirely removable and/or separatable from housing 18 to facilitate ease of winding/unwinding cord 16 relative thereto. In such an embodiment, converter 40 may be configured with one or more electrical contacts 50 (FIG. 3) that, engage and/or become electrically coupled to corresponding contacts connected to plug 20 (FIG. 1) when cord storage assembly 36 is located in the retracted position. Thus, in this embodiment, power adapter 10 is "off" unless cord storage assembly 36 is placed in the retracted and/or closed position (as illustrated in FIGS. 1, 2 and 5). Therefore, in some embodiments, when cord storage assembly 36 is moved away from a completely closed and/or retracted position.

Thus, embodiments of power adapter 10 enable cord 16 to be at least partially storable within housing 18 to reduce and/or substantially eliminate any excessive, unnecessary and/or unused portions of cord 16 extending between power adapter 10 and electronic device 12. Furthermore, embodiments of power adapter 10 enable all or substantially all of cord 16 to be stored within housing 18 when power adapter is not in use (e.g., when electronic device 12 is not in use and/or when electronic device 12 operating on battery power).

What is claimed is:

1. A power adapter, comprising:

a cord storage assembly that telescopingly extends from a location inside a housing to enable a cord to be at least partially wound around the cord storage assembly while the cord storage assembly remains connected to the housing, the cord storage assembly telescopingly retracts back to the location inside the housing to store the cord within the housing.

2. The power adapter of claim 1, wherein the cord storage assembly comprises at least one support extendable from the housing.

3. The power adapter of claim 1, wherein the housing comprises a plurality of walls, at least one of the walls comprising a recess to enable the cord to pass therethrough when the cord storage assembly is retracted within the housing.

4. The power adapter of claim 1, further comprising a plug coupled to the housing for connecting the power adapter to an alternating current supply.

5. The power adapter of claim 1, wherein an entire length of the cord is storable within the housing.

6. The power adapter of claim 1, wherein the storage assembly comprises a converter for converting an alternating current to direct current.

7. The power adapter of claim 1, wherein the cord storage assembly comprises a top wall for enclosing the housing when the power assembly is in the retracted position.

8. The power adapter of claim 1, wherein the cord storage assembly is configured to be separated from the housing.

9. The power adapter of claim 1, wherein the power adapter is off when the cord storage assembly is at least partially in an extended position relative to the housing.

10. A method of manufacturing a power adapter, comprising:

providing a cord storage assembly that telescopingly extends from inside a housing to enable a cord to be at least partially wound around the cord storage assembly while the cord storage assembly remains connected to the housing and that telescopingly retracts back inside of the housing to store the cord within the housing.

11. The method of claim 10, further comprising providing the cord storage assembly with two separated supports that extend between a top exterior wall of the housing and a wall of a power converter located inside the housing.

12. The method of claim 10, further comprising providing a recess on a wall of the housing to enable the cord to pass therethrough when the cord storage assembly is retracted within the housing.

13. The method of claim 10, further comprising providing a plug coupled to the housing for connecting the power adapter to an alternating current power supply.

14. The method of claim 10, further comprising providing the cord storage assembly to receive an entire length of the cord for storage within the housing.

15. The method of claim 10, further comprising a converter for converting alternating current to direct current.

16. The method of claim 10, further comprising providing a top wall on the cord storage assembly to enclose the housing when the storage assembly is retracted within the housing.

17. The method of claim 10, further configuring the cord storage assembly to be separated from the housing.

18. The method of claim 10, further comprising configuring the power adapter to be off when the cord storage assembly is at least partially in an extended position relative to the housing.

19. A power adapter, comprising:

a power converter;

a cord electrically connected to the power converter;

a cord storage assembly; and a housing that encloses the power converter, the cord, and the cord storage assembly, wherein the cord storage assembly moves from a location enclosed inside the housing to enable the cord to be wound around the cord storage assembly while the cord storage assembly remains connected to the housing and moves back to the location to store the cord inside the housing.

20. The power adapter of claim 19, wherein the cord storage assembly telecopingly extends from the location and telescopingly retracts back to the location.

21. The power adapter of claim 19, wherein the cord storage assembly includes a top wall the forms an exterior surface of the housing and at least one post that extends between the top wall and a surface of the power converter.

22. The power adapter of claim 19, wherein the cord storage assembly include two spaced apart posts around which the cord is wound and unwound when the cord storage assembly is moved from the location inside of the housing.

* * * * *

UNITED STATES PATENT AND TRADEMARK OFFICE

CERTIFICATE OF CORRECTION

PATENT NO. : 7,871,291 B2
APPLICATION NO. : 11/888402
DATED : January 18, 2011
INVENTOR(S) : Mark S. Tracy et al.

It is certified that error appears in the above-identified patent and that said Letters Patent is hereby corrected as shown below:

In column 4, line 54, in Claim 20, delete “telecopingly” and insert -- telescopingly --, therefor.

In column 4, line 57, in Claim 21, delete “wall the” and insert -- wall that --, therefor.

Signed and Sealed this
Tenth Day of May, 2011

David J. Kappos

David J. Kappos
*Director of the United States Patent and Trademark Office*